United States Patent [19]

Taylor et al.

[11] Patent Number: 4,947,612

[45] Date of Patent: Aug. 14, 1990

[54] BRACING SYSTEM

[76] Inventors: John W. R. Taylor, 33887 Gilmour Drive, Abbotsford, Canada, V2S 6B4; John M. Palmer, 6570 - 148th Street, Surrey, Canada, V3S 3C6; Emanuel Butkovsky, 202 - 1111 Haro Street, Vancouver, Canada, V6E 1E3

[21] Appl. No.: 189,204

[22] Filed: May 2, 1988

[51] Int. Cl.[5] ..... E04C 3/02

[52] U.S. Cl. ..... 52/693; 52/695; 52/729

[58] Field of Search ..... 52/DIG. 6, 317, 643, 52/693, 695, 696, 729, 690

[56] References Cited

U.S. PATENT DOCUMENTS

| | | | |
|---|---|---|---|
| 1,725,414 | 8/1929 | Parish | 52/695 |
| 4,122,647 | 10/1978 | Kovar | 52/695 |
| 4,195,462 | 4/1980 | Keller et al. | 52/729 X |

*Primary Examiner*—David A. Scherbel

*Assistant Examiner*—Anthony W. Williams

*Attorney, Agent, or Firm*—Christie, Parker & Hale

[57] ABSTRACT

A cross-brace for connection to a pair of parallel conventional joists comprises elongate brace members assembled to form a X-shaped array, with a pair of vertical reinforcement members extending between outer ends of the brace members. The brace members and reinforcement members are connected to one another and, when the cross-brace is assembled with the joists, the reinforcement members abut mutually opposed sides of the joists. When I-beams are employed, the outer ends of the brace members and the opposite ends of the reinforcement members cooperate to form right-angled notches for snugly receiving longitudinal beam members, which are interconnected in pairs by web members against which the reinforcement members abut. The web members are connected by dovetail joints to the beam members instead of simply being inserted in a conventional manner into slots in the beam members.

18 Claims, 2 Drawing Sheets

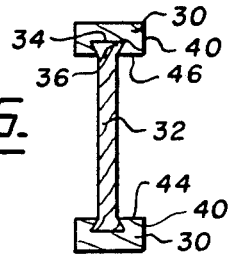
Fig. 5.
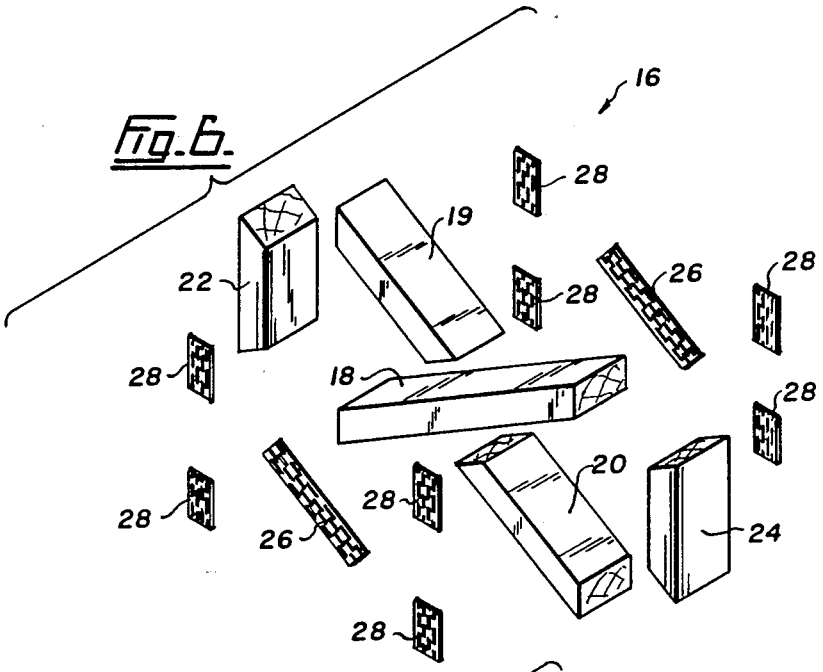
Fig. 6.
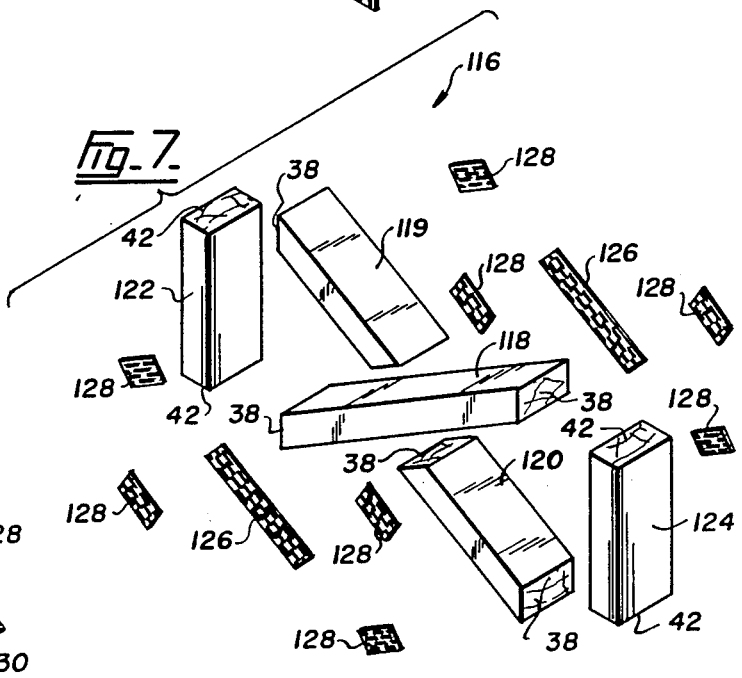
Fig. 7.
Fig. 8.

BRACING SYSTEM

FIELD OF THE INVENTION

The present invention relates to cross-braces for connection to a pair of parallel joists or beams, and to structural assemblies comprising joists or beams interconnected by cross-braces.

DESCRIPTION OF THE PRIOR ART

In a conventional building construction, floor joists are often provided with braces connecting the joists to resist lateral bending of the joists. Also, it is well known to form such braces as cross-braces, i.e. braces comprising elongate brace members assembled to form an X-shaped array, these cross-braces being connected between the joists with the brace members extending at an inclination to opposed vertical side faces of the joists.

It is also well known to construct joists as I-beams, comprising an assembly of a pair of beam members interconnected by a web member having opposite longitudinal edge portions connected to opposed faces of the beam members.

It is a disadvantage of conventional cross-braces that they provide lateral support for the joists only at the tops and the bottoms of the joists, i.e. at the locations at which the outer ends of the brace members abut the opposed vertical side faces of the joists.

SUMMARY OF THE INVENTION

It is accordingly an object of the present invention to provide improved cross-braces which provide improved lateral support for joists, so that the joists can be spaced further apart than in prior art structures, thus reducing the number of joists required in a structure.

According to the present invention, there is provided a cross-brace for connection to a pair of parallel beams, comprising elongate brace members assembled to form an X-shaped array, a pair of vertical reinforcement members extending between the outer ends of the brace members and means for connecting the brace members to one another and to the reinforcement members.

For use with I-beams comprising pairs of beam members interconnected by webs, the present cross-brace may be so adapted that opposite ends of the reinforcement members, together with the outer ends of the brace members, define outwardly-open angular recesses of substantially right-angled cross-section for snugly receiving the beam members.

The present invention further provides a structural assembly comprising a pair of I-beams each comprising a pair of beam members and a web interconnecting the beam members, and a plurality of cross-braces interconnecting the I-beams, the cross-braces each comprising elongate brace members assembled to form an X-shaped array extending between the I-beams and a pair of vertical reinforcement members extending between the outer ends of the brace members, and each of the reinforcement members extending between the beam members of a respective one of the I-beams adjacent the web thereof.

The present invention still further provides an I-beam comprising a pair of elongate beam members and a web interconnecting said beam members, the beam members defining recesses extending longitudinally of mutually opposed surfaces of the beam members and said recesses each having a transverse cross-sectional shape which diverges inwardly of the respective beam member, the web members having longitudinal edge portions received in the recesses and the longitudinal edge portions having cross-sectional shapes which diverge outwardly to interfit snugly with the recesses.

BRIEF DESCRIPTION OF THE DRAWINGS

The invention will be more readily understood from the following description of embodiments thereof given, by way of example, with reference to the accompanying drawings, in which.

FIG. 5 shows a view in cross-section through an I-beam such as those shown in FIGS. 3 and 4;

FIG. 6 shows an exploded view, in perspective, of the components of the structure shown in FIGS. 1 and 2;

FIG. 7 shows an exploded view, in perspective, of the components of the structure shown in FIGS. 3 and 4; and FIG. 8 shows a broken-away view in perspective of a truss plate such as those employed in the structure of FIGS. 1 to 7.

DESCRIPTION OF THE PREFERRED EMBODIMENT

Figure 1:
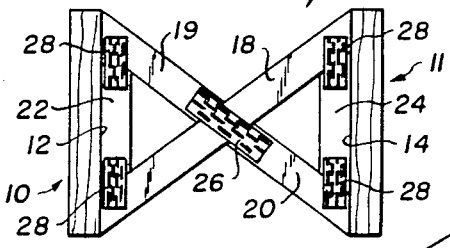
FIG. 1 shows a view in cross-section through a first embodiment of a conventional building structure braced according to the present invention.
Figure 2:
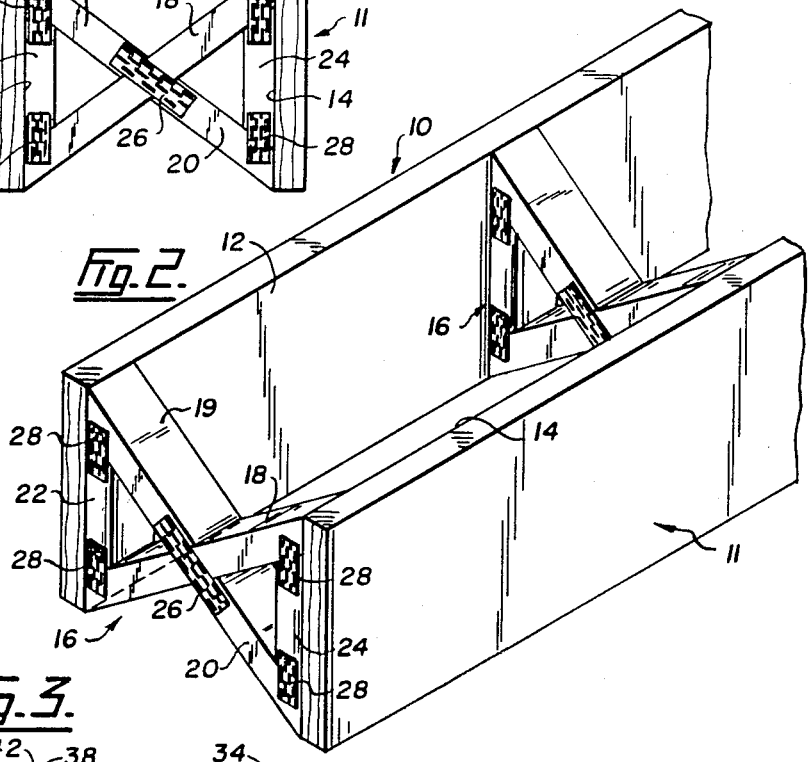
FIG. 2 shows a view in perspective of the structure of FIG. 1.

The structure illustrated in FIGS. 1, 2 and 6 comprises a pair of conventional parallel joists indicated generally by reference numerals 10 and 11, which are of rectangular shape with opposed flat vertical side faces 12 and 14.

A pair of cross-braces, indicated generally by reference numeral 16, extend between the side faces 12 and 14 for stiffening the joists 10 and 11.

Each of the cross-braces 16 comprises three elongate brace members 18, 19 and 20, which are connected together in an X-shaped array. The brace member 18 is longer than the brace members 19 and 20 and abuts, at opposite end faces thereof, against the surfaces 12 and 14 of the joists 10 and 11. The brace members 19 and 20, on the other hand, have their outer end faces in abutment with the joist surfaces 12 and 14, respectively, but have inner ends thereof in abutment with the brace member 18.

Vertical reinforcement members 22 and 24 extend between the free ends of the brace members 18, 19 and 20 and have outer side surfaces which are in alignment with the brace member end faces to form therewith opposite flat lateral extremities of the cross braces and which abut the joist side surfaces 12 and 14. As can be seen from FIGS. 1 and 2, the thus-formed lateral extremities or side faces of the cross braces 16 extend flush to the tops and bottoms of the cross braces 16 so as to allow the latter to fit between the joists 10 and 11 without projecting into or upwardly beyond the joists 10 and 11.

The brace members 18, 19 and 20 are connected to one another and to the vertical reinforcement members 22 and 24 by means of conventional truss plates 26 and 28.

As will be readily apparent from the above description and from FIGS. 1, 2 and 6, the cross-braces illustrated therein, as compared with conventional cross-braces lacking the reinforcement members 22 and 24, provide additional stiffening for the joists 10 and 11 and thus reinforce these joists against lateral deflection.

Figure 3:
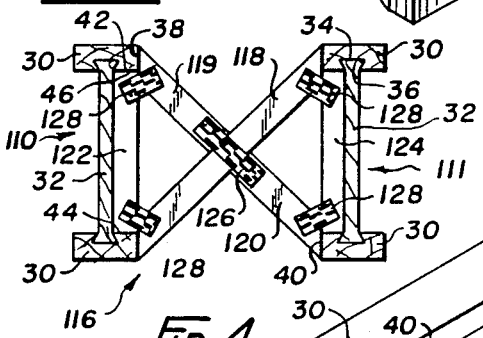
FIG. 3 shows a view taken in vertical cross-section through the structure of FIG. 4.
Figure 4:
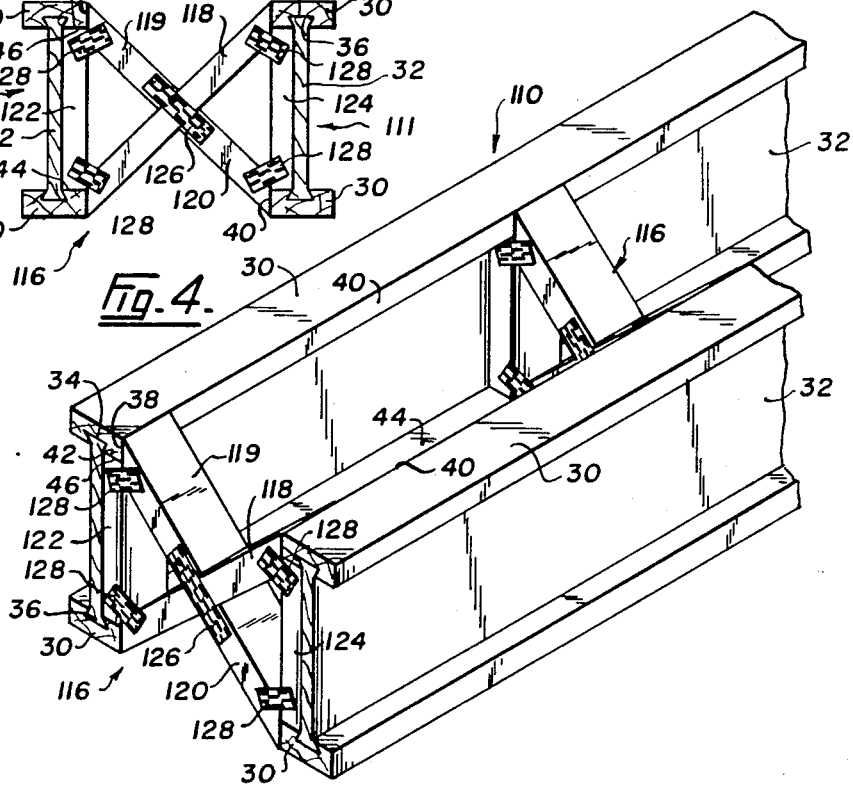
FIG. 4 shows a view in perspective of an I-beam building structure according to a second embodiment of the present invention.

In the second embodiment of the invention, illustrated in FIGS. 3, 4 and 7 of the drawing, parts which correspond to those of FIGS. 1 and 2 have been indicated by the same reference numerals increased by 100.

The structure illustrated in FIGS. 3 and 4 comprises a pair of I-beams, indicated generally by reference numerals 110 and 111.

The beams 110 and 111 are each formed from a pair of beam members or cords 30 interconnected by an intermediate one piece web member 32.

Each web member 32 has longitudinal edge portions 34 which are outwardly divergent to form solid dovetail-shaped cross-sections so that the edge portions 34 each have a width greater than the thickness of the remainder of the web member 32, and the beams 30 are formed with correspondingly-shaped longitudinal slots or recesses 36, which diverge inwardly of the beams 30 in a dovetail shape. The edge portions 34 and the recesses 36 thus interfit snugly to form dovetail joints between the webs 32 and the beam members 30. The edge portions 34 and the web 32 are made in one piece, for example, by extrusion. They may be of metal, plastic or wood.

The I-beams 110 and 111 are interconnected by cross-braces 116, which each comprise an X-shaped array of elongate brace members 118, 119 and 120.

The cross-braces 116 also include vertical reinforcement members 122 extending between the outer ends of the brace members 118, 119 and 120.

In this embodiment of the invention, the outer ends of the brace members 118, 119 and 120 present vertical, laterally outwardly directed end faces 38, which abut side faces 40 of the beam members 30, and the reinforcement members 122 present horizontal end faces 42, which abut mutually opposed faces 44 and 46 of the beam members 30. Thus, the vertical faces 38 and the horizontal faces 42 define outwardly-open angular recesses of substantially right-angled cross-section which snugly receive the beam members 30. Also, the thickness of the reinforcement members 122, in the plane of FIG. 4, is equal to the horizontal spacing of the side faces 40 from the web 32. The brace member end faces 38 extend to tops of the cross braces 116 so as to the latter to fit between the joists 110 and 111 without projecting upwardly beyond the joists 110 and 111.

The brace members 118, 119 and 120 are connected together by truss plates 126 and are connected to the reinforcement members 122 by truss plates 128. An example of one of these truss plates, which are of conventional manufacture, is shown in FIG. 8 and is made of sheet metal stamped to form prongs 130 for penetrating engagement in the components of the cross-braces.

In both of the illustrated embodiments, the brace members have a rectangular cross-section, the major dimension of which is perpendicular to the place of the X-shaped array of the respective cross-brace.

The above-described structures may be made of wood, plastic, metal or any combination thereof.

We claim:

1. A cross brace for connection to a pair of parallel I-beam joists each comprising a pair of beam members interconnected by a web, said cross brace comprising:

elongate brace members assembled to form an X-shaped array;

a pair of reinforcement members extending between the outer ends of said brace members; and means for connecting said brace members to one another and to said reinforcement members;

opposite ends of said reinforcement members together with the outer ends of said brace members defining outwardly-open angular recesses of substantially right-angled cross-section for snugly receiving said beam members.

2. A structural assembly comprising a pair of I-beams, said I-beams each comprising a pair of beam members and a web interconnecting said beam members, and a plurality of cross braces interconnecting said I-beams, said cross braces each comprising:

elongate brace members assembled to form an X-shaped array extending between said I-beams;

a pair of vertical reinforcement members extending between the outer ends of said brace members;

each of said reinforcement members extending between said beam members of a respective one of said I-beams adjacent the web thereof;

said reinforcement members and said brace members being connected together with the ends thereof meeting at right angles to define outwardly-open notches snugly receiving said beam members so that opposite ends of said reinforcement members and the outer ends of said brace members are in face-to-face engagement with said beam members.

3. A structural assembly claimed in claim 2, wherein said brace members and said reinforcement members each have a rectangular cross-section the major dimension of which extends in a direction perpendicular to the plane of said X-shaped array.

4. A structural assembly as claimed in claim 2, wherein said beam members define longitudinal recesses in mutually opposed faces of said beam members, said webs have edge portions engaged in said recesses and said edge portion and said recesses are shaped to form dovetail joints between said webs and said beam members.

5. A cross brace for connection to a pair of parallel joists, comprising:

elongate brace members assembled to form an X-shaped array;

a pair of reinforcement members extending between the outer ends of said brace members; and a plurality of connector plate members pressed into gripping engagement with said brace members and said reinforcement members for securing together said brace members and said reinforcement members.

6. A cross-brace as claimed in claim 5 for use with I-beam comprising pairs of beam members interconnected by webs, wherein opposite ends of said reinforcement members together with the outer ends of said brace members define outwardly-open angular recesses of substantially right-angled cross-section for snugly receiving the beam members.

7. A cross-brace as claimed in claim 5, wherein said brace members and said reinforcement members each have a rectangular cross-section the major dimension of which extends in a direction perpendicular to the plane of said X-shaped array.

8. A cross brace for interconnecting opposed sides of a pair of joists, comprising:

elongate brace members extending in an X-shaped array;

means for rigidly interconnecting the outer ends of said brace members, said interconnecting means comprising a pair of reinforcement members extending between the outer ends of said brace members;

said cross brace having flat lateral extremities to allow said cross brace to be entirely accommodated between said opposed sides of said joists without projecting beyond said opposed sides, and said flat lateral extremities comprising flat outer surfaces on said reinforcement members for surface-to-surface abutment with said opposed sides of said joists.

9. A cross brace as claimed in claim 8, wherein said lateral cross brace extremities include laterally outwardly-directed end faces on said brace members, said end faces of said brace members being aligned with said outer surfaces of said reinforcement members.

10. A cross brace as claimed in claim 9, wherein said brace members and said reinforcement members each have a rectangular cross-section the major dimension of which extends in a direction perpendicular to the plane of said X-shaped array.

11. A cross brace as claimed in claim 8 for use with I-beams each comprising a pair of cords interconnected by webs, wherein opposite ends of said reinforcement members together with the outer ends of said brace members define outwardly-open angular recesses of substantially right-angled cross-section for snugly receiving said cords.

12. A cross brace as claimed in claim 11, wherein said brace members and said reinforcement members each have a rectangular cross-section the major dimension of which extends in a direction perpendicular to the plane of said X-shaped array.

13. A cross brace as claimed in claim 8, further comprising a plurality of connector plate members pressed into gripping engagement with said brace members and said reinforcement members for securing together said brace member sand said reinforcement members.

14. A structural assembly, comprising:

a plurality of parallel solid joists having opposed sides and spaced apart from one another;

a plurality of cross braces interconnecting said joists;

each of said cross braces being located in its entirety between said opposed sides of a pair of said joists so that the other sides and the tops of said pair of joists remain entirely free of obstruction by said cross braces;

said cross brace having flat lateral extremities allowing said cross braces to be entirely accommodated between said opposed sides of said joists;

said cross braces being in abutment with said opposed sides of said joists from the tops to the bottoms of said cross brace;

said cross braces each comprising elongate brace members assembled to form an X-shaped array extending between said joists and a pair of reinforcement members extending between the outer ends of said brace members at said opposite sides of the respective cross brace, said cross braces comprising flat outer surfaces on said reinforcement members, and;

said flat outer surfaces being disposed in surface-to-surface abutment with said opposed sides of said joists.

15. A structural assembly as claimed in claim 14, wherein said brace members have end faces in face-to-face abutment with said joists and in alignment with said outer surfaces of said reinforcement members.

16. A structural assembly as claimed in claim 15, wherein said beam members define longitudinal dovetail-shaped recesses in mutually opposed faces of said cords, and said webs have solid dovetail-shaped widened edge portions engaged in said recesses to form dovetail joints between said webs and said cords.

17. A structural assembly as claimed in claim 14, wherein said joists comprise I-beams, and said I-beams each comprise a pair of cords and a web interconnecting said beam members, each of said reinforcement members extending between, and having opposite ends in abutment with, said cords of a respective one of said I-beams adjacent the web thereof, and said reinforcement members and said brace members being connected together with the ends thereof meeting at right angles to define outwardly-open notches snugly receiving said cords.

18. A structural assembly as claimed in claim 14, further comprising a plurality of connector plate members pressed into gripping engagement with said brace members and said reinforcement members for securing together said brace member and said reinforcement members.

* * * * *